US005820283A

United States Patent [19]

Sunada et al.

[11] Patent Number: 5,820,283

[45] Date of Patent: Oct. 13, 1998

[54] PRINT MEDIA HANDLING SYSTEM INCLUDING DUAL INCLINE SUPPORT FOR CONTROLLING PEN TO PAPER SPACING

[75] Inventors: Craig D. Sunada; Larry A. Jackson; Juli K. Noble, all of Vancouver, Wash.

[73] Assignee: Hewlett-Packard Company, Palo Alto, Calif.

[21] Appl. No.: 768,364

[22] Filed: Dec. 17, 1996

[51] Int. Cl.[6] ..... B41J 13/10

[52] U.S. Cl. ..... 400/642; 271/209

[58] Field of Search ..... 400/617, 619, 400/624, 578, 642, 646, 648, 656, 647, 647.1; 271/161, 188, 209

[56] References Cited

U.S. PATENT DOCUMENTS

| | | | |
|---|---|---|---|
| 4,728,963 | 3/1988 | Rasmussen et al. . | |
| 4,843,338 | 6/1989 | Rasmussen et al. . | |
| 4,872,026 | 10/1989 | Rasmussen et al. . | |
| 5,356,229 | 10/1994 | Hickman et al. | 400/642 |
| 5,393,151 | 2/1995 | Martin et al. . | |
| 5,419,644 | 5/1995 | Martin et al. . | |
| 5,527,123 | 6/1996 | Jackson et al. | 400/642 |
| 5,575,575 | 11/1996 | Ide et al. | 400/656 |

*Primary Examiner*—Ren Yan

[57] ABSTRACT

A media handling system includes a drive roller, an elongated pinch roller and a contoured support. The pinch roller extends across the print medium near the print zone to control the localized shape of the print medium. The support underlies the print medium in the print zone and includes first and second underlying pivotal inclines. The pinch rollers push the print medium onto the first pivotal incline adjacent to the drive roller. The second underlying incline is located downstream toward the print zone exit. As the print medium is fed through the print zone, a portion of the print medium within the print zone between the pivotal inclines is suspended exhibiting a reverse bowing. Beyond the second pivotal incline the print medium droops. The presence of the two underlying inclines more uniformly distributes the stress accompanying the bowing of the print medium within the print zone.

13 Claims, 3 Drawing Sheets

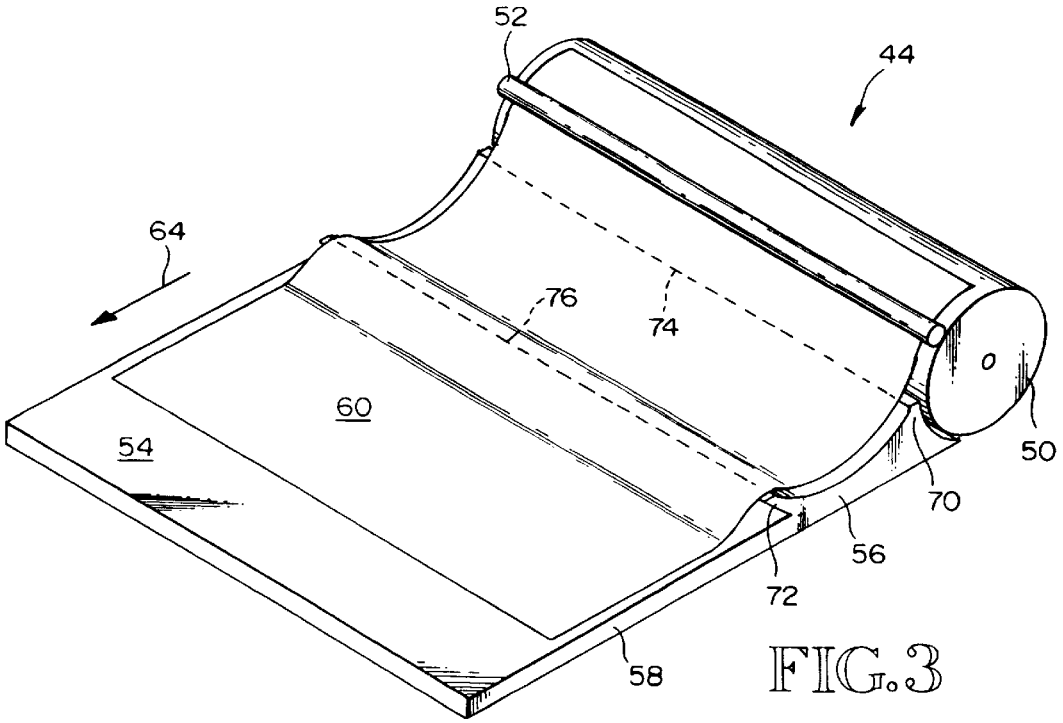
FIG. 3
FIG. 4
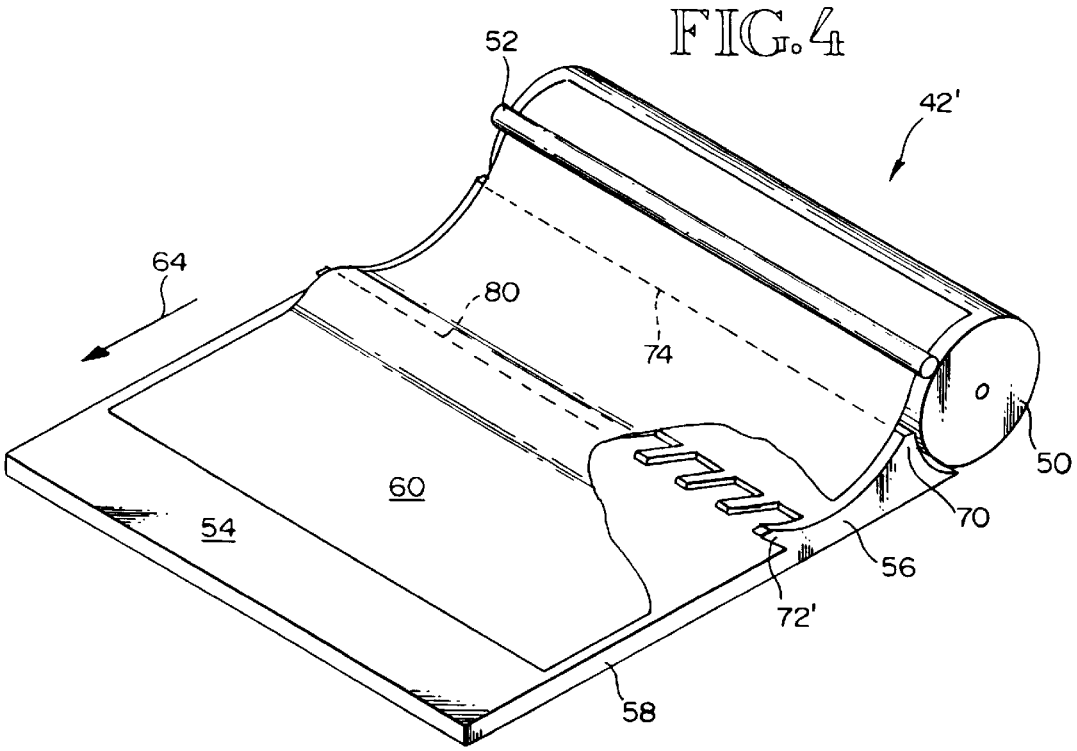

PRINT MEDIA HANDLING SYSTEM INCLUDING DUAL INCLINE SUPPORT FOR CONTROLLING PEN TO PAPER SPACING

BACKGROUND OF THE INVENTION

This invention relates generally to pen-to-print medium spacing during printing in a wet ink printer. More particularly, this invention relates to a print media handling system with a print media support located within a print zone. The support has a profile which imposes a shape on the print media for reducing cockling during printing.

Typically ink-jet printers, or any other printers using wet ink, include a printhead and a media handling system. A print zone, a region where printing occurs, is adjacent to the printhead. The media handling system includes a feed mechanism for feeding a print medium into and through the print zone. The media handling system also includes a platen which underlies the print zone and supports the print medium as it passes through the print zone.

During printing, ink is dropped, ejected or otherwise output from the printhead into the print zone and onto the print medium. Ink used in wet ink-type printing includes a relatively large amount of water. As the wet ink contacts the print medium, the water in the ink saturates the fibers of the print medium, causing the fibers to expand, which in turn causes the print medium to buckle. Such buckling action also is referred to as cockling. Cockling of the print medium tends to cause the print medium to bend in an uncontrolled manner downward away from the printhead and upward toward the printhead. Cockling varies the pen to print medium spacing ('PPS') and the pen to print medium angle ('PPA'). A constant PPS and PPA is desired to assure a desired print quality. Varying these measures, as during cockling, can reduce print quality. In the extreme an upwardly buckling print medium contacts a pen nozzle causing ink to smear on the print medium. In a worst case scenario an upwardly buckling print medium in contact with a nozzle damages the nozzle.

Pen to print medium spacing ('PPS') is defined as the average normal distance from an orifice plate of the printhead to the print medium (while dry) over the print zone. Alternatively, one or more PPS's are defined as the respective normal distances from the orifice plate to the print medium (while dry) at one or more respective locations within the print zone. Pen to print medium angle ('PPA') is defined as an average angle between the pen and the dry print medium, based upon the angle of the orifice plate to a least squares slope of the paper in the print zone. Such angle is measured in a plane normal to the direction of print media carriage travel.

FIG. 1 shows an inkjet pen 10 and a conventional print media handling system 12. The inkjet pen 10 includes a plurality of nozzles 14 for emitting ink at a nozzle orifice plate 16. The print zone 18 occurs adjacent to the orifice plate 14 in the region of the nozzles 14. The media handling system 12 includes a drive roller 20, a pinch roller 22, a cockle shim 24, and a platen 26. The drive roller 20 is positioned adjacent to an entrance area of the print zone 18. The platen 26 includes a generally flat expanse and an incline 28. The incline 28 includes an edge which contacts the underside of the print medium 30 along a line of contact. The drive roller 20 feeds the print medium 30 into the print zone 18 downward toward the platen 26. The pinch roller 22 holds the print medium 30 far back along the drive roller 20. The cockle shim 24 pushes the print medium 30 downward forcing the print medium to maintain contact with the incline 28 while the print medium is fed through the print zone. The print medium 30 is characterized as having a reverse bow between the incline 28 and the cockle shim 24 and a droop bow beyond the incline 28. The term "reverse" in "reverse bow" is used because the print medium curvature is opposite that which is induced by the feed roller 20.

The print medium 30 is suspended in a generally concave-shaped curve relative to the printhead 10 between the cockle shim 24 and the line of contact with the platen 26 (e.g., along the flat region or incline 28 depending on the stage of feeding the print medium). Once the leading edge of the print medium 30 is downstream of the incline 28, the leading edge is unsupported allowing the droop bow. The purpose of the varying curvature is to reduce cockling of the print medium.

SUMMARY OF THE INVENTION

According to the invention, an improved media handling system includes a dual underlying incline support and locates a pinch roller adjacent to the print zone. The result is improved cockle control and better print quality.

According to one aspect of the invention, an elongated pinch roller is located on the periphery of a drive roller toward the print zone. The pinch roller holds the print medium to the drive roller. The holding force controls the shape of the print medium in the vicinity of the pinch roller and drive roller. By locating the pinch roller adjacent to the print zone, the pinch roller and drive roller control print medium shape over a wider portion of the print medium at the beginning portion of the print zone. As a result, cockle is reduced at such beginning portion of the print zone.

According to another aspect of the invention, a dual incline support defines two underlying pivot points for the print medium in the vicinity of the print zone. The support underlies the printhead and borders the print zone at a region adjacent to the drive roller and pinch roller. The pinch roller pushes the print medium onto a first underlying incline. A first line of contact is formed across the print medium between the incline and the print medium. As the drive roller pushes the print medium through the print zone the lead edge of the print medium encounters a second underlying incline. The second underlying incline is located within or toward an exit portion of the print zone. A second line of contact is formed across the print medium between the second incline and the print medium. As the drive roller pushes the print medium through the print zone, the pinch roller keeps the print medium in contact with the first underlying incline. The first incline imposes a curvature on the print medium. The stress on the print medium due to such imposed curvature causes the print medium to maintain contact with the second underlying incline.

According to another aspect of this invention, the support defines a concave curvature relative to the printhead between the two underlying inclines. As the print medium is fed through the print zone, the print medium is supported by the two inclines. The print medium is elevated above the support between the two inclines and bows toward the underlying support contour. The bowing is a reverse bowing relative to the bending about the drive roller and induces a stress in the print medium. The stress serves to limit the print medium cockling during wet ink printing. The presence of the two underlying inclines more uniformly distributes the stress along the print medium in the direction of travel for that portion within the print zone. Specifically, the concave profile of the support and the spacing of the underlying inclines impose an elongated flatter bowing of the print medium within the print zone. A desired stress is imposed on the print medium in the print zone to limit cockling while also reducing the pen to print medium angle within the print zone. It is because the stress is more uniform that not as much bowing is needed to keep cockling within desired limits near the printhead nozzles. Thus, cockling is controlled and/or improved while also improving pen to print media angle and thus print quality.

These and other aspects and advantages of the invention will be better understood by reference to the following detailed description taken in conjunction with the accompanying drawings.

BRIEF DESCRIPTION OF THE DRAWINGS

FIG. 3 is a schematic isometric view of the media handling system of FIG. 2;

FIG. 4 is an alternative embodiment of the media handling system of FIG. 2.

DESCRIPTION OF SPECIFIC EMBODIMENTS

Overview

Figure 1:
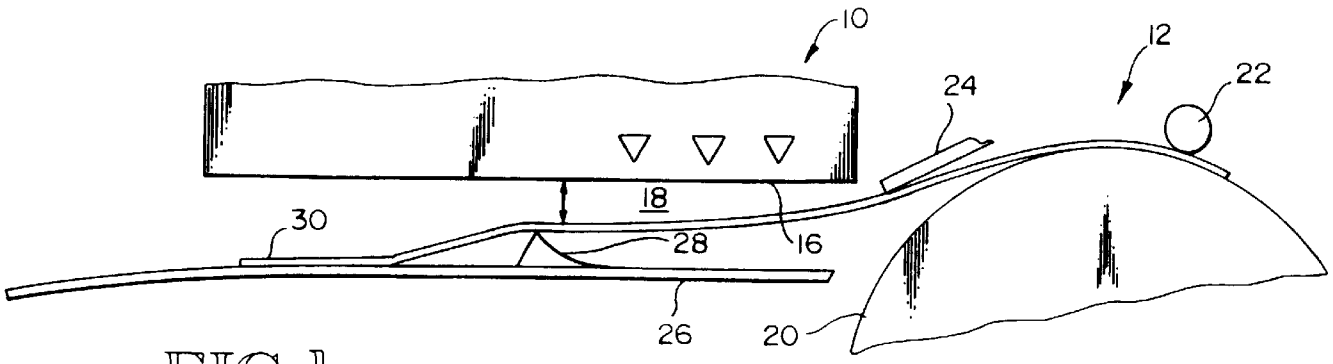
FIG. 1 PRIOR ART
FIG. 1 is a planar partial profile diagram of a conventional print medium handling system for reducing cockling.
Figure 2:
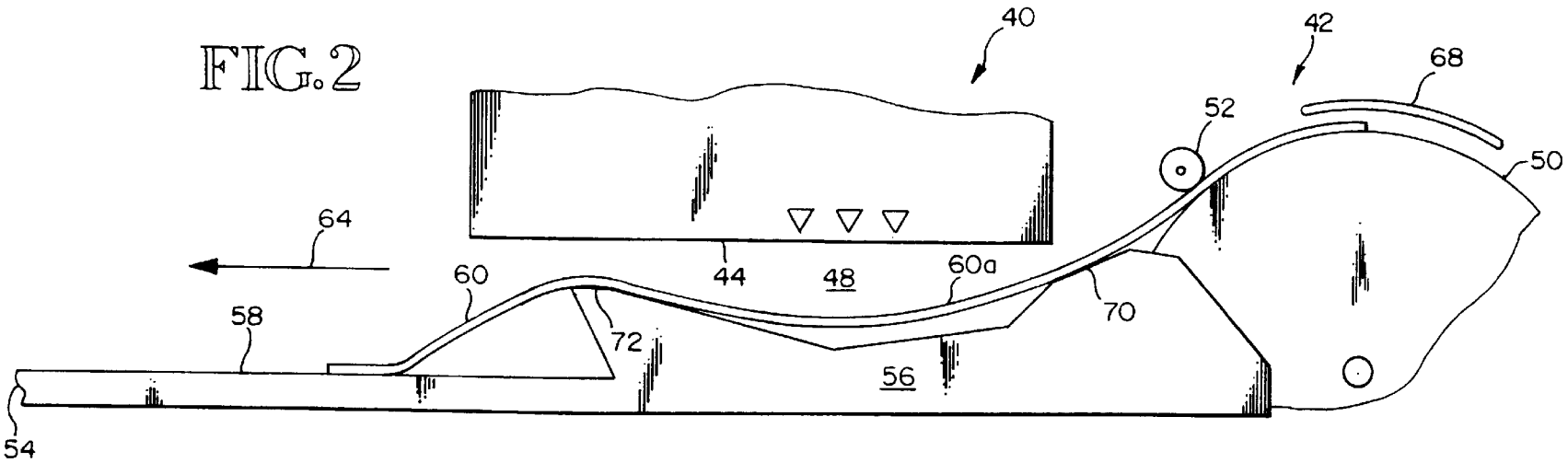
FIG. 2 is a planar partial profile diagram of a print medium handling system for limiting print medium cockling according to an embodiment of this invention.

FIG. 2 shows a wet ink printer pen 40 and a media handling system 42 according to an embodiment of this invention. Pen 40 includes a printhead 44 having a plurality of nozzles 46 for emitting ink into a print zone 48. The print zone 48 occurs adjacent to the printhead 44 in the region of the nozzles 46. The media handling system 42 includes a drive roller 50, a pinch roller 52, and a platen 54. The drive roller 50 and pinch roller 52 are positioned adjacent to an entrance area of the print zone 48. The pinch roller 52 pushes a print medium 60 to the drive roller 50. As the drive roller 50 rotates, the print medium 60 is driven along the drive roller, then onto and along the adjacent platen 54. The platen 54 includes a contoured region 56 and a generally flat expanse 58. The contoured region 56 is positioned generally adjacent to the printhead 44. The print zone 48 is located between the platen's contour region 56 and the printhead 44. In operation nozzles 46 drop or eject ink droplets onto an upper surface 60*a* of the print medium 60 as the print medium is moved in a direction of travel 64 along the platen 54.

Typically the printhead 44 is horizontally positioned so that the nozzles 46 emit ink droplets from an underside of the pen 40. Alternatively, the printhead 44 is angled or vertically oriented with the print medium 60 being correspondingly oriented in the print zone to receive emitted ink droplets. The ink typically includes a large portion of water such that when the ink is printed onto the print medium 60, the ink at times saturates component print medium fibers. This saturation causes the fibers to expand, which in turn causes buckling or cockling of the print medium material. Exemplary print media material experiencing cockling include paper, cardboard, envelope material or other fibrous sheet material. The ink is any liquid based wet ink or any other ink that causes buckling of the print medium.

Media Handling and Support

In operation a sheet of print medium 60 is picked from an input tray or other input source and fed onto the drive roller 50. A guide 68 directs the print medium 60 onto the drive roller. Typically the drive roller 50 has an elastomeric outer surface. Friction between the drive roller 50 and print medium moves the print medium along the drive roller as the roller 50 spins. One or more pinch rollers 52 are located at a peripheral edge of the drive roller at a location toward the print zone 48 side of the drive roller 50. The pinch roller 52 is biased against the drive roller 50 outer surface. Once the print medium 60 is moved into the region between the pinch roller 52 and the drive roller 50, the pinch roller 52 holds the print medium 60 against the drive roller. As the drive roller 50 rotates, the print medium 60, unable to overcome the force of friction, is driven along the drive roller periphery.

An upstream end of the platen 54, (e.g., the contoured region 56) is located adjacent to the drive roller 50. Such end prevents the print medium 60 from continuing around the drive roller surface as the print medium moves about the drive roller. As a result, the print medium 60 is driven forward onto the platen 54 and into the print zone 48.

The pinch roller 52 is located at a position along the drive roller 50 such that the print medium 60 portion exiting the grip of the pinch roller 52 is oriented downward toward a first pivotal incline 70 of the platen contour region 56. The portion of the print medium 60 exiting the drive roller 50 establishes contact with the first pivotal incline 70. In one embodiment a line of contact 74 (see FIG. 3) is defined between the first pivotal incline 70 and the print medium 60. The first pivotal incline 70 provides underlying support for the print medium 60. In a preferred embodiment the line of contact 74 extends along a width of the print medium in a direction generally perpendicular to the print medium direction of travel 64. In an alternative embodiment the first pivotal incline 70 is formed by a plurality of parallel ribs, each rib adjacent to the drive roller 50. In such alternative embodiment a segmented line of contact extends along the width of the print medium in a direction generally perpendicular to the print medium direction of travel 64.

In a preferred embodiment the contoured region 56 has a concave shape relative to the printhead 44 within the print zone 48. The concave shape forms an arc extending in the direction of travel 64 from the first pivotal incline 70 to a second pivotal incline 72. Beyond the second pivotal incline 72 the platen 54 drops off to the elongated flat region 58. The second pivotal incline 72 is at a height above the flat region 58 allowing the print medium 60 to droop down onto the flat region 58. As the print medium 60 is moved into and through the print zone 48, the print medium portion between the first pivotal incline 70 and second pivotal incline 72 bows downward toward the concave contour of the contour region 56. In a preferred embodiment the print medium 60 is suspended between the platen 54 and print head 44 within the print zone 48 between the contact at the first pivotal incline 70 and the contact at the second pivotal incline 72. The print medium 60 is reverse bowed between the first pivotal incline 70 and the second pivotal incline 72 to define a concave shape relative to the printhead 44 along the direction of travel. The print medium is droop bowed at the second pivotal incline 72 to define a convex shape relative to the printhead 44 along the direction of travel 64.

In one embodiment a line of contact 76 (see FIG. 3) is defined between the second pivotal incline 72 and the print medium 60. The second pivotal incline 72 provides underlying support for the print medium 60. In a preferred embodiment the line of contact 76 extends along a width of the print medium in a direction generally perpendicular to the print medium direction of travel 64. In an alternative embodiment (see FIG. 4) the second pivotal incline 72' is formed by a plurality of parallel ribs or cockle springs located toward the exit of the print zone 48. In such alternative embodiment a segmented, and in some embodiments uneven, line of contact 80 extends along the width of the print medium 60 in a direction generally perpendicular to the print medium direction of travel 64.

Figure 5:
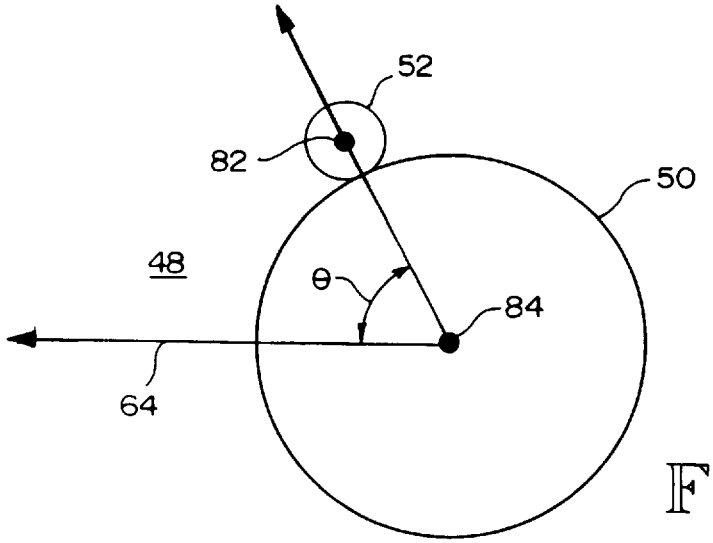
FIG. 5 is a diagram of the angular position of the pinch roller of FIG. 2 relative to the drive roller and print zone.

In various embodiments the pinch roller 52 is formed by one or more rollers located in a common line along the drive roller surface and having a common axis or rotation. To bias the print medium 60 onto the first pivotal incline 70 during movement of the print medium from the drive roller 50 into and through the print zone 48 the pinch roller 52 is located at a prescribed angle. In preferred embodiments the pinch roller 52 is positioned adjacent to a peripheral edge of the drive roller 50 such that an angle θ (see FIG. 5) formed between an axis of rotation 82 of the pinch roller 52 and the general direction of print medium travel 64 along the platen 54 (i.e., along the flat portion 58) and having a vertex 84 at an axis of rotation of the drive roller 50 is between 30° and 80°.

Meritorious and Advantageous Effects

According to one advantage of the invention, by moving the pinch roller 52 closer to the print zone 48, the rollers 50, 52 control print medium shape over a wider portion of the print medium 60 at the beginning of the print zone. As a result cockle is reduced toward the beginning of the print zone near such rollers. According to another advantage of the invention, the presence of two underlying inclines 70, 72 more uniformly distributes the stress accompanying the reverse bowing of the print medium. Because the stress is more uniform not as much bowing is needed to keep cockling within desired limits near the printhead nozzles. Thus, cockling is controlled and/or improved while also improving pen to print media angle and thus print quality.

Although a preferred embodiment of the invention has been illustrated and described, various alternatives, modifications and equivalents may be used. For example, although the inclines 70, 72 are shown to be integral to a common platen, in alternative embodiments, the inclines 70, 72 are formed as stationary or spring-biased ribs projecting from one or more platens or other support structures. In another embodiment the inclines form separate components mounted in place on or adjacent to a platen or other support structure. Therefore, the foregoing description should not be taken as limiting the scope of the inventions which are defined by the appended claims.

What is claimed is:

1. A printer mechanism for controlling pen to print medium spacing during printing, the mechanism comprising:

a printhead for printing on a print medium;

a platen located adjacent to the printhead for supporting the print medium during printing as the print medium moves along the platen in a direction of motion, wherein a print zone is defined between the platen and the printhead, the platen comprising a first underlying incline for supporting the print medium at a first contact region and a second underlying incline for supporting the print medium at a second contact region, the second underlying incline being located further along the platen than the first underlying incline in a forward direction of travel of the print medium;

a drive roller for driving the print medium into the print zone and along the platen; and a pinch roller that holds the print medium to the drive roller so that rotation of the drive roller moves the print medium, the pinch roller being positioned relative to the drive roller to maintain the print medium in contact with the first underlying incline, the first underlying incline located closer to the drive roller than the second underlying incline; and wherein the print medium bows in a concave direction relative to the printhead along the direction of travel between the first underlying incline and the second underlying incline, and wherein the print medium bows in a convex direction relative to the printhead along the direction of travel at the second underlying incline, wherein the concave and convex bowing induced by the first and second underlying inclines limits cockling of the print medium within the print zone during printing.

2. The mechanism of claim 1, wherein a first surface of the platen located between the first underlying incline and the second underlying incline has a concave shape relative to the printhead.

3. The mechanism of claim 1, wherein the first contact region is a first line of contact generally perpendicular to the forward direction of travel, and the second contact region is a second line of contact generally perpendicular to the forward direction of travel.

4. The mechanism of claim 1, in which the pinch roller is positioned adjacent to a peripheral edge of the drive roller such that an angle between an axis of rotation of the pinch roller and the direction of print medium travel along the platen which has a vertex at an axis of rotation of the drive roller is not more than 80°.

5. The mechanism of claim 4, in which said angle is at least 30°.

6. A printer mechanism for controlling pen to print medium spacing during printing, the mechanism comprising:

a printhead for printing on a print medium;

a platen located adjacent to the printhead for supporting the print medium during printing as the print medium moves along the platen in a direction of motion, wherein a print zone is defined between the platen and the printhead, the platen comprising a first underlying incline for supporting the print medium at a first contact region and a second underlying incline for supporting the print medium at a second contact region, the second underlying incline being located further along the platen than the first underlying incline in a forward direction of travel of the print medium;

a drive roller for driving the print medium into the print zone and along the platen; and a pinch roller that holds the print medium to the drive roller so that rotation of the drive roller moves the print medium, the pinch roller being positioned relative to the drive roller to maintain the print medium in contact with the first underlying incline, the first underlying incline located closer to the drive roller than the second underlying incline; and wherein the print medium is suspended between the platen and the printhead within the print zone between the first underlying incline and the second underlying incline; and wherein the print medium bows in a concave direction relative to the printhead along the direction of travel between the first underlying incline and the second underlying incline, and wherein the print medium bows in a convex direction relative to the printhead along the direction of travel at the second underlying incline, wherein the concave and convex bowing induced by the first and second underlying inclines limits cockling of the print medium within the print zone during printing.

7. The mechanism of claim 6, in which the pinch roller is positioned adjacent to a peripheral edge of the drive roller such that an angle between an axis of rotation of the pinch roller and the direction of print medium travel along the platen which has a vertex at an axis of rotation of the drive roller is not more than 80°.

8. The mechanism of claim 7, in which said angle is at least 30°.

9. A method for limiting cockling of a print medium during wet ink printing, comprising the steps of:

driving the print medium through a print zone where ink is received onto the print medium;

biasing the print medium to contact a first underlying incline, the first incline supporting the print medium during travel through the print zone; and supporting the print medium with a second underlying incline which contacts the print medium, the second underlying incline located further along a direction of travel than the first underlying incline;

wherein the print medium bows in a first direction along the direction of travel between the first underlying incline and the second underlying incline, and wherein the print medium bows in a second direction opposite the first direction along the direction of travel at the second underlying incline, wherein the bowing induced by the first and second underlying inclines stresses the print medium to limit cockling of the print medium within the print zone during printing.

10. The method of claim 9, in which the print medium is suspended within the print zone between the first underlying incline and the second underlying incline.

11. The method of claim 9, in which a pinch roller holds the print medium to a drive roller adjacent to the print zone, and in which the step of biasing comprising biasing the print medium into contact with the first underlying incline by positioning the pinch roller at a prescribed angle relative to the drive roller, wherein the prescribed angle is formed between an axis of rotation of the pinch roller and the direction of print medium travel and has a vertex at an axis of rotation of the drive roller.

12. The method of claim 11, in which the angle is not more than 80°.

13. The method of claim 12, in which said angle is at least 30°.

* * * * *